United States Patent [19]

Marra

[11] Patent Number: 5,063,627

[45] Date of Patent: Nov. 12, 1991

[54] DRYWALL TOOL

[76] Inventor: Dominic A. Marra, 260 Columbus Ave., Pawtucket, R.I. 02861

[21] Appl. No.: 597,513

[22] Filed: Oct. 15, 1990

[51] Int. Cl.[5] ..... B44C 7/00

[52] U.S. Cl. ..... 7/105; 7/158; 30/169

[58] Field of Search ..... 7/105, 158, 164, 165; 15/236.01, 236.04; 30/169

[56] References Cited

U.S. PATENT DOCUMENTS

| | | | |
|---|---|---|---|
| 825,063 | 7/1906 | Lawbaugh | 7/105 |
| 2,092,586 | 9/1937 | Naumovich | 7/105 X |
| 2,194,307 | 3/1940 | Jackson | 7/105 X |
| 2,213,071 | 8/1940 | Keller | 7/105 X |
| 2,839,110 | 6/1958 | Carpenter | 7/105 X |
| 3,562,826 | 2/1971 | Vaughn | 7/105 |
| 4,598,476 | 7/1986 | Grasse | 30/169 |

*Primary Examiner*—James G. Smith
*Attorney, Agent, or Firm*—Leon Gilden

[57] ABSTRACT

A tool structure defined by an elongate handle, with a taping blade integrally mounted with the cutting edge orthogonally arranged relative to the handle. The handle includes a hammering surface integrally mounted to the handle at a rear terminal end thereof, with an elongate longitudinal slot mounted within a side wall of the handle to pivotally mount a screw driver blade therewithin. A modification of the invention includes an auxiliary handle to enhance force application to the taping blade in use, as well as a further slot mounting a cutting blade therewithin. The handle may be further modified to mount a measuring tape thereto.

3 Claims, 4 Drawing Sheets

DRYWALL TOOL

BACKGROUND OF THE INVENTION

1. Field of the Invention

The field of invention relates to drywall tool apparatus, and more particularly pertains to a new and improved drywall tool wherein the same includes an assembly to accommodate a craftsman in a taping and scraping procedure relative to the construction of drywall or "sheet rock" type wall structures.

2. Description of the Prior Art

In the construction and erection of various drywall organizations, a variety of tools are frequently required such as a scraping blade, a screw driver for the adjustment of projecting screws directed through the wall, as well as various cutting and measuring procedures associated with drywall construction. The prior art has provided various categories of multiple use tools and examples of such may be found in U.S. Pat. No. 3,858,258 to Stevens wherein a hand tool includes a file, a plurality of screw drivers, and a knife member.

U.S. Pat. No. 4,125,913 to Lewis sets forth a tool utilizing an elongate shank with a plurality of tool members integrally mounted relative to the tool arranged in a cross-like configuration.

U.S. Pat. No. 4,617,692 to Bond, et al. sets forth a tool for drilling and securing screw anchors to the wall, wherein the tool provides a drill tip for securement to a lower terminal end of an anchor, as well as a handle for mounting the anchor in application of sufficient force to effect the drilling and mounting of the anchor within an associated wall.

U.S. Pat. No. 3,742,533 to Brunett sets forth a further example of a multipurpose tool, including various tool structures mounted thereon particularly for use by aircraft mechanics to include screw driver fittings and the like.

As such, it may be appreciated that there continues to be a need for a new and improved drywall tool as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of drywall tools now present in the prior art, the present invention provides a drywall tool wherein the same provides for a drywall tool which permits a taping and screw driver procedure in the construction of drywall structures. As such, the general purpose of the present invention, which will be described subsequently in greater detail, is to provide a new and improved drywall tool which has all the advantages of the prior art drywall tools and none of the disadvantages.

To attain this, the present invention provides a tool structure defined by an elongate handle, with a taping blade integrally mounted with the cutting edge orthogonally arranged relative to the handle. The handle includes a hammering surface integrally mounted to the handle at a rear terminal end thereof, with an elongate longitudinal slot mounted within a side wall of the handle to pivotally mount a screw driver blade therewithin. A modification of the invention includes an auxiliary handle to enhance force application to the taping blade in use, as well as a further slot mounting a cutting blade therewithin. The handle may be further modified to mount a measuring tape thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drywall tool which has all the advantages of the prior art drywall tools and none of the disadvantages.

It is another object of the present invention to provide a new and improved drywall tool which may be easily and efficiently manufactured and marketed.

It is a further object of the present invention to provide a new and improved drywall tool which is of a durable and reliable construction.

An even further object of the present invention is to provide a new and improved drywall wall tool which is susceptible of a low cost of manufacture with regard to both materials and labor, and which accordingly is then susceptible of low prices of sale to the consuming public, thereby making such drywall tools economically available to the buying public.

Still yet another object of the present invention is to provide a new and improved drywall tool which provides in the apparatuses and methods of the prior art some of the advantages thereof, while simultaneously overcoming some of the disadvantages normally associated therewith.

Still another object of the present invention is to provide a new and improved drywall tool wherein the same utilizes a multiplicity of various tool members mounted to a single structure to accommodate various procedures encountered in drywall construction.

These together with other objects of the invention, along with the various features of novelty which characterize the invention, are pointed out with particularity the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
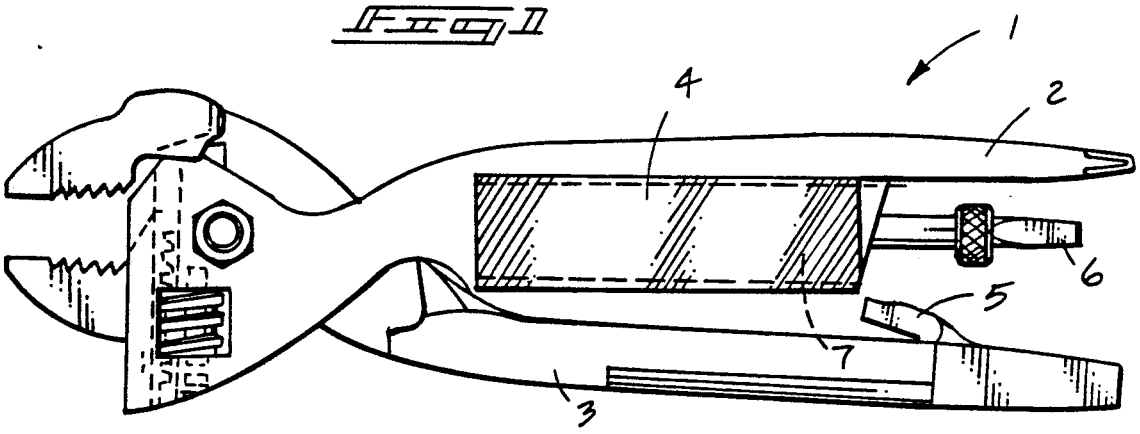
FIG. 1 is an orthographic side view, taken in elevation, of a prior art multiple use tool.
Figure 2:
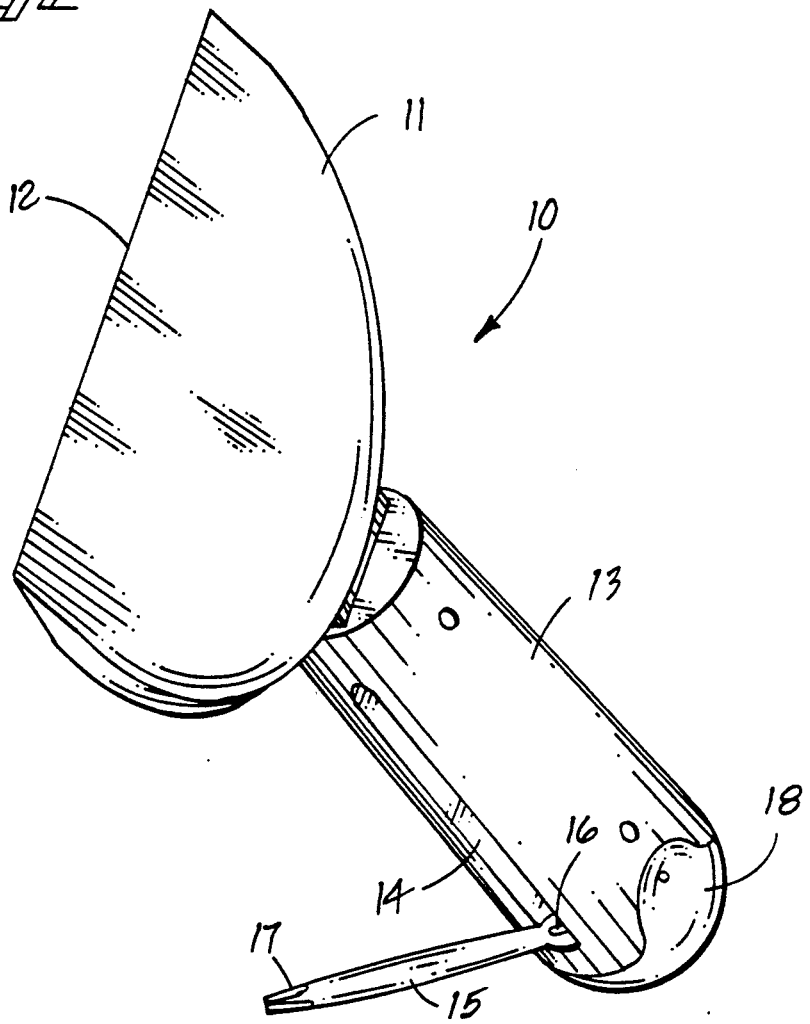
PRIOR ART Fig 2
FIG. 2 is an isometric illustration of the instant invention.
Figure 3:
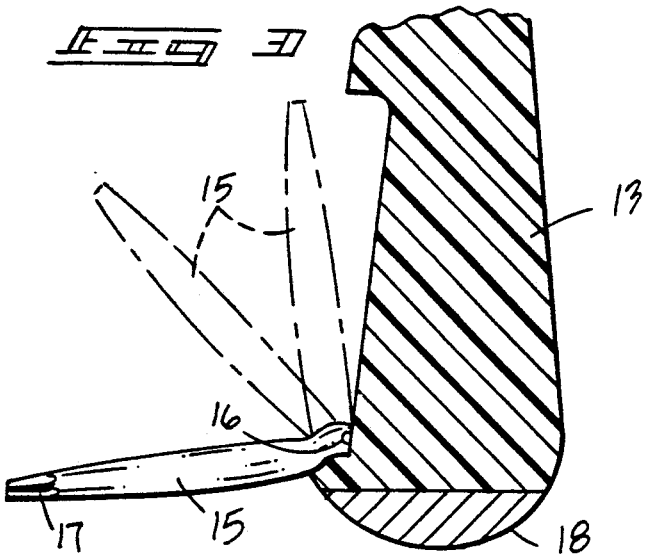
FIG. 3 is an orthographic cross-sectional illustration of the handle utilized by the instant invention.

With reference now to the drawings, and in particular to FIGS. 1 to 8 thereof, a new and improved drywall tool embodying the principles and concepts of the present invention and generally designated by the reference numeral 10 will be described.

FIG. 1 illustrates a prior art multiple use tool setting forth the arrangement and securement of various tool components in a single unitary body, with a plurality of crossed handles 2 and 3 respectively mounting various screw driver blades at terminal ends thereof, with a sheath member 4, including a file surface underlying a knife blade 7. A tool member 5 is further mounted to the handle structure 3 for use in a conventional manner for ignition of various fires.

More specifically, the drywall tool 10 of the instant invention essentially comprises a rigid taping blade 11, including an elongate edge 12 mounted at a forward terminal end of the taping blade 11 coextensively arranged relative to the forward edge. The taping blade 11 is integrally mounted to an elongate longitudinally aligned handle 13 that is orthogonally oriented relative to the elongate edge 12. The handle 13 includes an elongate longitudinally aligned slot 14 formed on a first side of the handle 13, with a screw driver shaft 15 that includes a pivot axle 16 that pivotally mounts the screw driver shaft 15 within the slot 14. A forward terminal end of the screw driver shaft 15 includes a screw driver blade 17 mounted thereon. A cup-shaped cover member 18 integrally and fixedly mounted to the rear terminal end of the handle 13 remote from the taping blade 11 is of a metallic construction to define a hammering surface 18 that is generally arcuate to permit an individual to apply force in a comfortable and convenient manner thereto, but to also provide a hammering surface for assisting in the depressing of nails and the like in a drywall construction procedure.

Figure 5:
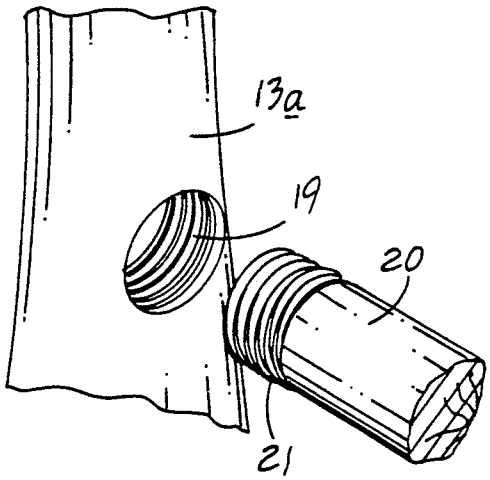
FIG. 5 is an isometric cross-sectional illustration of the accessory handle mounted to the handle structure of the drywall tool.
Figure 4:
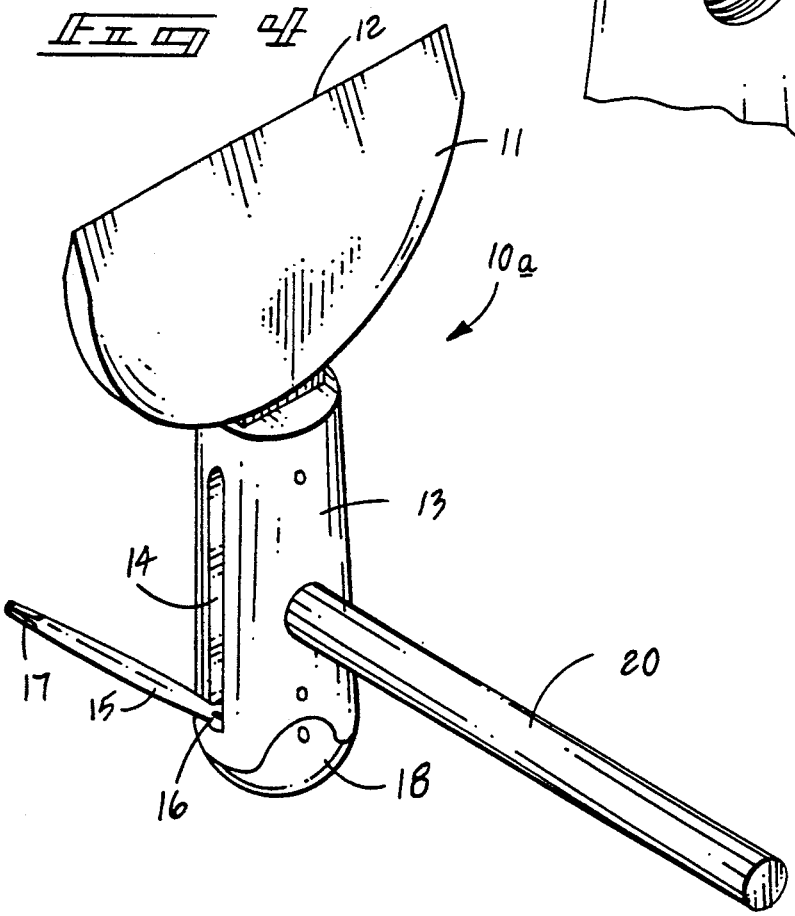
FIG. 4 is an isometric illustration of the instant invention utilizing an accessory handle.

FIGS. 4 and 5 illustrate the use of a threaded bore 19 orthogonally directed within the handle 13 and orthogonally oriented relative to a longitudinal axis defined by the handle 13 that complementary receives a handle threaded lower terminal end 21 therewithin. The threaded lower end mounted to a lower end of an auxiliary handle 20 provides an individual to apply additional force in the use of the taping blade 11 and the screw driver 17.

Figure 6:
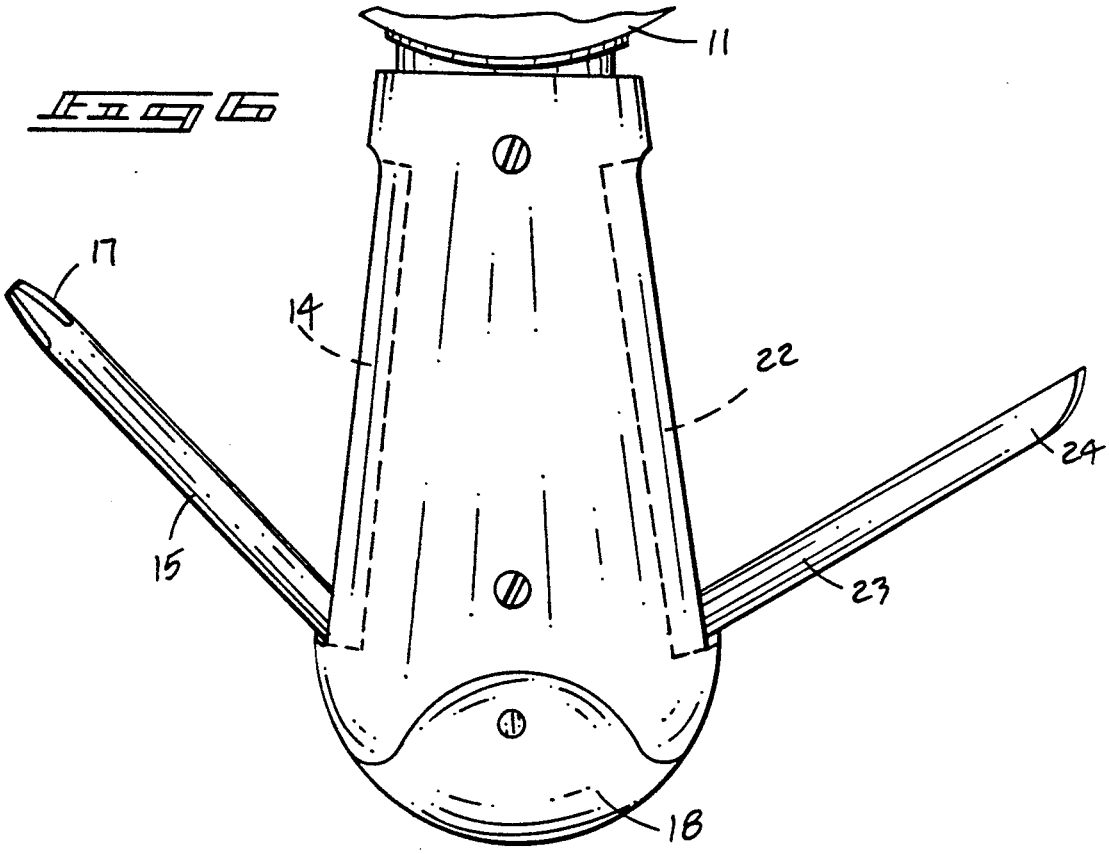
FIG. 6 is an orthographic side view, taken in elevation, of a modified handle structure utilized by the instant invention.

FIG. 6 illustrates a modified handle 13 that includes a further elongate slot 22 directed through a second side of the handle 13 opposed to that of the first slot 14 within the first side of the handle. The further slot 22 accommodates a knife blade 23 pivotally mounted and complementarily receivable within the second slot, with the knife blade 23 including a knife blade cutting edge 24 formed at an outer terminal end of the knife blade 23.

Figure 7:
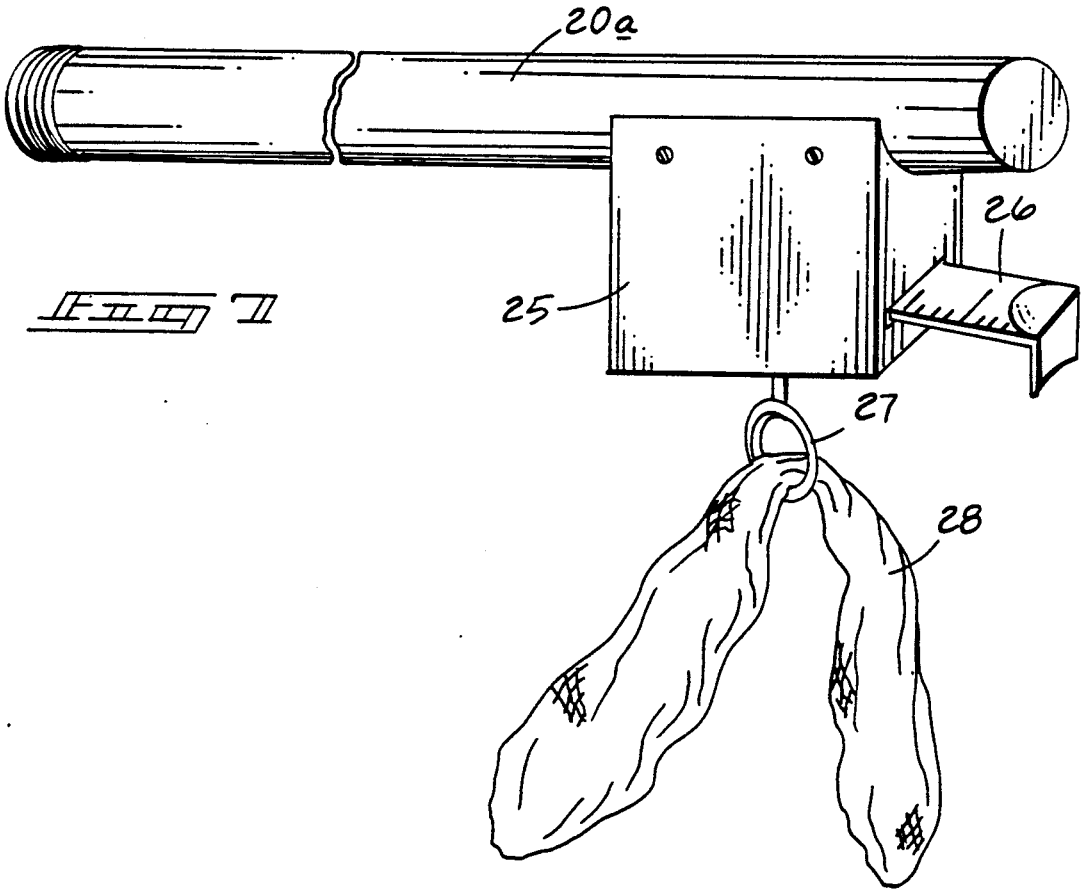
FIG. 7 is an isometric illustration of a modified accessory handle utilized by the instant invention.
Figure 8:
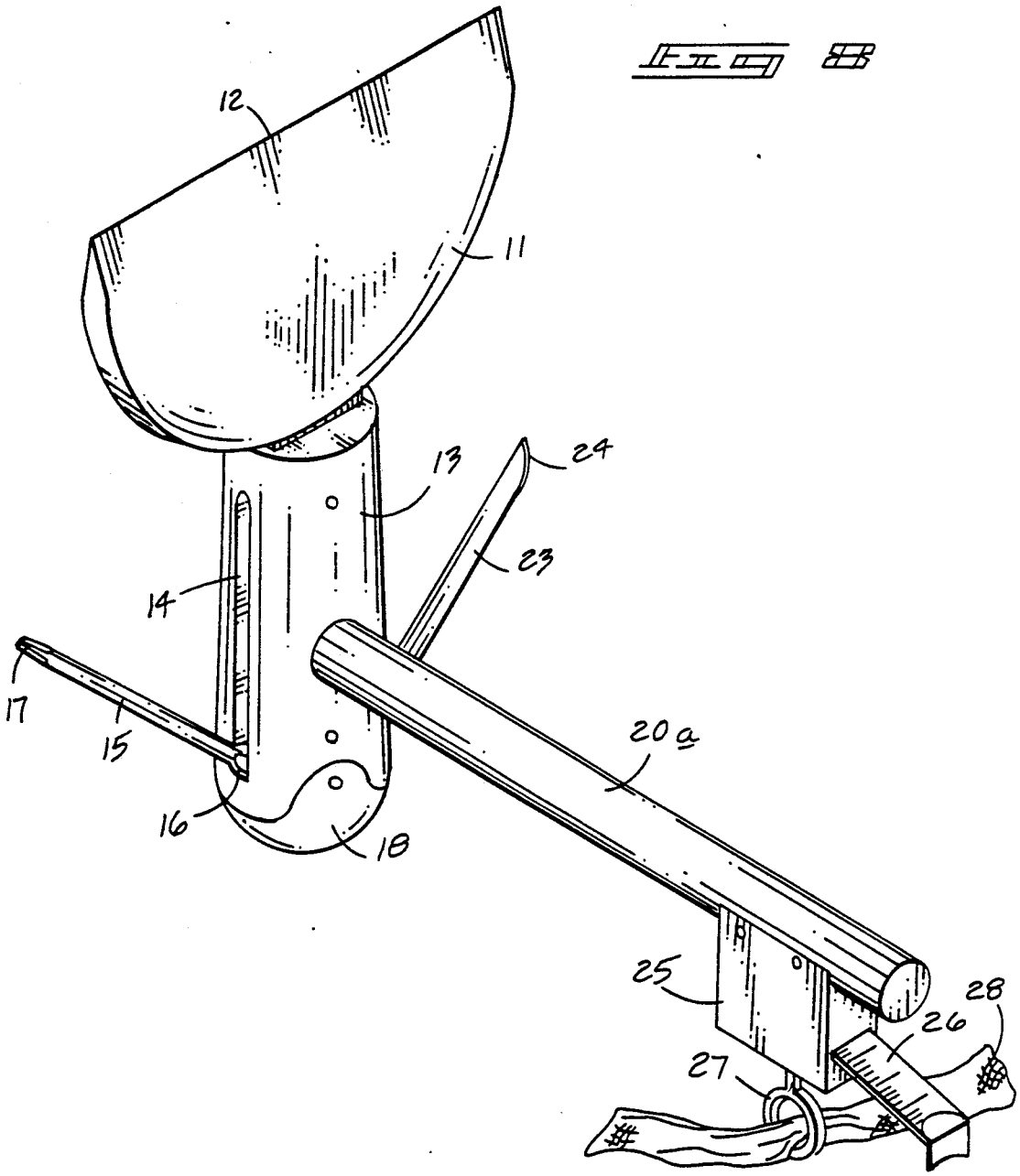
FIG. 8 is an isometric illustration of the modified drywall tool utilized by the instant invention.

FIGS. 7 and 8 illustrate the modified tool structure utilizing a modified auxiliary handle 20 that further includes a housing 25 mounting a measuring tape 26 retractably therewithin. The housing 25 further supports a support ring 27 for the convenient storage of a cleaning fabric 28 for use in cleaning of the elongate edge 12 and various components of the tool in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drywall tool comprising, in combination, a rigid taping blade, the taping blade including an elongate forward terminal end, and a handle integrally mounted to the taping blade remote from the elongate edge, with the handle longitudinally aligned and orthogonally oriented relative to the elongate edge, and the handle including a first side and a second side, with the first side including an elongate longitudinal slot directed therewithin, and an elongate shaft including a pivot axle pivotally mounting the elongate shaft within the elongate slot, and a screw driver blade mounted to an outer terminal end of the elongate shaft remote from the pivot axle, and further including a cup-shaped metallic cover member fixedly mounted to a rear terminal end of the handle remote from the taping blade, and including a further elongate slot directed through the second side of the handle, with the second slot including a knife blade pivotally mounted and complementarily receivable within the further elongate slot, with the cutting edge formed to an outer terminal end of the knife blade, and including a threaded bore orthogonally directed through the elongate handle orthogonally oriented relative to the longitudinal axis of the handle, and a longitudinally aligned auxiliary handle including a threaded lower terminal end, with the threaded lower terminal end complementarily receivable within the threaded bore.

2. An apparatus as set forth in claim 1 wherein the auxiliary handle includes a housing fixedly mounted to the auxiliary handle remote from the threaded lower terminal end, and the housing including a measuring tape retractably mounted within the housing.

3. An apparatus as set forth in claim 2 with a support ring fixedly mounted to the housing, and a cleaning fabric positioned within the support ring to effect effective cleaning of the taping blade, screw driver blade, and knife blade.

* * * * *